US010024277B2

(12) United States Patent
Duquesne et al.

(10) Patent No.: US 10,024,277 B2
(45) Date of Patent: Jul. 17, 2018

(54) ENGINE AIR PRE CLEANER EVACUATION SYSTEM FOR WORK MACHINE

(71) Applicant: CNH Industrial America LLC, New Holland, PA (US)

(72) Inventors: Frank R. G. Duquesne, Zwevegem (BE); Lode A. Demonie, Staden (BE); Jolan Heyns, Oostkamp (BE)

(73) Assignee: CNH Industrial America LLC, New Holland, PA (US)

( * ) Notice: Subject to any disclaimer, the term of this patent is extended or adjusted under 35 U.S.C. 154(b) by 132 days.

(21) Appl. No.: 14/974,923

(22) Filed: Dec. 18, 2015

(65) Prior Publication Data

US 2016/0177894 A1 Jun. 23, 2016

(30) Foreign Application Priority Data

Dec. 19, 2014 (BE) ..... 2014/0859

(51) Int. Cl.

| | |
|---|---|
| ***F01P 5/06*** | (2006.01) |
| ***F02M 35/08*** | (2006.01) |
| ***F01P 11/12*** | (2006.01) |
| ***F01P 5/02*** | (2006.01) |
| ***F02M 35/04*** | (2006.01) |
| ***F02M 35/06*** | (2006.01) |

(Continued)

(52) U.S. Cl.

CPC ..... *F02M 35/086* (2013.01); *F01P 5/02* (2013.01); *F01P 11/12* (2013.01); *F02M 35/044* (2013.01); *F02M 35/06* (2013.01); *F02M 35/164* (2013.01); *F01P 5/06* (2013.01); *F04D 29/545* (2013.01)

(58) Field of Classification Search

CPC ..... F01P 5/06; F01P 11/12; F01P 5/02; F04D 29/545; F02M 35/086; F02M 35/044; F02M 35/06; F02M 35/164

USPC ..... 123/41.49

See application file for complete search history.

(56) References Cited

U.S. PATENT DOCUMENTS 5,190,217 A * 3/1993 Black ..... B05B 7/1495 239/154

5,466,189 A 11/1995 Deutsch et al.

(Continued)

FOREIGN PATENT DOCUMENTS

| | | |
|---|---|---|
| EP | 0313763 A1 | 5/1989 |
| EP | 1262645 A2 | 12/2002 |

*Primary Examiner* — Jacob Amick
*Assistant Examiner* — Charles Brauch
(74) *Attorney, Agent, or Firm* — Peter K. Zacharias; Patrick M. Sheldrake

(57) ABSTRACT

A work machine with an internal combustion engine is provided with an air inlet for receiving combustion air, wherein an air pre-cleaner is mounted in the inlet, a radiator, a cooling air fan and a debris removal means, configured to remove debris from a flow of air produced by the cooling air fan through the radiator, the removal means comprising a screen for collecting the debris, and an aspirator for aspirating the debris away from the screen, and a venturi element mounted downstream of the aspirator, and having an inlet portion, a throat portion and an outlet portion, wherein a duct is mounted between the engine air pre-cleaner and the throat portion, so that particles removed by the pre-cleaner flow towards the throat portion, and out through the outlet portion of the venturi element, together with the aspirated debris.

4 Claims, 1 Drawing Sheet

(51) Int. Cl.
*F02M 35/16* (2006.01)
*F04D 29/54* (2006.01)

(56) References Cited

U.S. PATENT DOCUMENTS

| | | | | |
|---|---|---|---|---|
| 7,682,413 | B2 | 3/2010 | Sheidler | |
| 7,878,171 | B2 | 2/2011 | Vandike et al. | |
| 7,946,368 | B2 | 5/2011 | Vandike et al. | |
| 2009/0308346 | A1* | 12/2009 | Vandike | F02M 35/02 123/198 E |
| 2011/0246030 | A1* | 10/2011 | Jueptner | A01D 69/00 701/50 |
| 2014/0090800 | A1 | 4/2014 | Dossner et al. | |

* cited by examiner

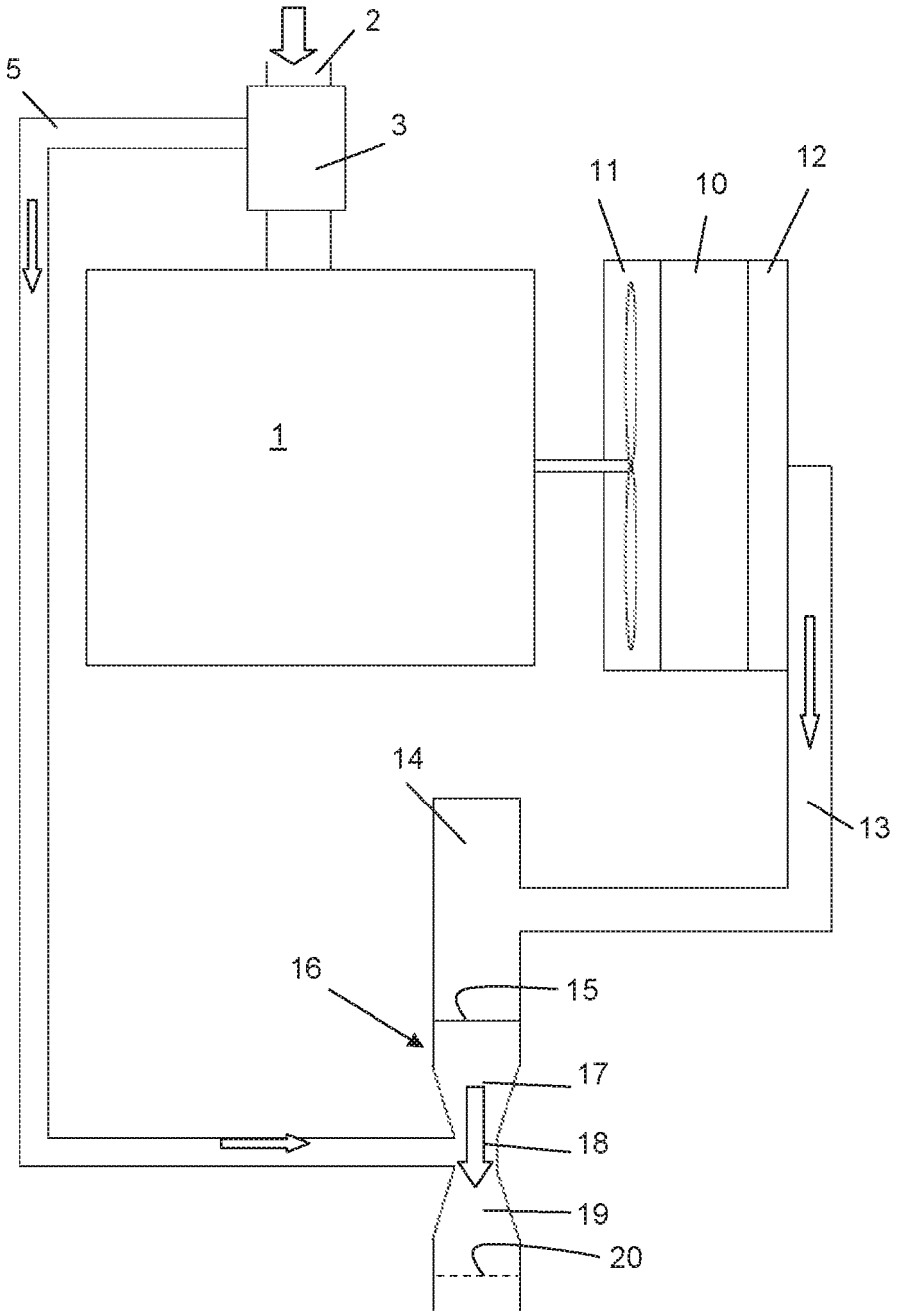
2
5
3
11
10
12
1
14
13
16
15
17
18
19
20

ENGINE AIR PRE CLEANER EVACUATION SYSTEM FOR WORK MACHINE

This application claims priority to Belgium Application BE2014/0859 filed Dec. 19, 2014, which is incorporated herein by reference in its entirety.

FIELD OF THE INVENTION

The present invention is related to work machines, such as agricultural harvesting machines for gathering and processing crop material from a field. The invention is in particular related to an improved means for the removal of dust and particles from an air pre-cleaner provided for the internal combustion engine that is powering the work machine.

STATE OF THE ART

Work machines are generally operating in environments that impose important requirements on the cleaning of the air used in the internal combustion process of the driving engine. This is especially true for agricultural machines. An air pre-cleaner is therefore provided in these machines, designed to remove larger particles of dust, straw or other contaminants from the air prior to the air's introduction in the air filter of the engine. The removal of these unwanted elements from the pre-cleaner takes place through aspiration, by way of a suction source located elsewhere in the machine. A number of possible solutions have been documented.

One possibility is to install an aspirator in the engine exhaust, as illustrated for example by EP-A-313763. However, the introduction of particles in the hot exhaust gas represents a fire hazard, while a stable aspiration of particles is not ensured in this solution due to the fact that the aspiration depends on the engine's operational state in terms of speed and load. Other solutions consist in applying an aspirator that is used in the first place for removing debris from the engine cooling air, for the additional purpose of extracting particles from the pre-cleaner. One solution of this type is shown in U.S. Pat. No. 7,878,171, wherein a venturi device is placed upstream of a fan that works as an aspirator for removing debris from the cooling air, the debris being collected by a rotating screen placed in front of the engine radiator. A pipe connects the outlet of the engine air pre-cleaner to the throat section of the venturi device, thereby aspirating dust and other particles from the pre-cleaner. These particles thereby join the flow of debris removed from the cooling air at a location upstream of the aspirator fan. While this solution removes the fire hazard and instability problems, the joining of the particle stream from the pre-cleaner and the debris stream from the radiator reduces the efficiency of the aspirator fan and may cause damage to the fan and fan housing because of hard particles coming from the pre-cleaner. This problem is solved in the agricultural machine shown in US2010/0006361, which comprises an aspirator fan comprising one housing and multiple fan chambers, so that aspiration of the cooling air debris and of the pre-cleaner output remains separated. This is a solution but it is technically complex and expensive.

SUMMARY OF THE INVENTION

The present invention is related to a work machine as disclosed in the appended claims. According to the invention, a venturi element is mounted downstream of the aspirator fan, said venturi element being connected to the outlet of the engine air pre-cleaner. This design ensures a better performance of the aspirator.

BRIEF DESCRIPTION OF THE FIGURES

FIG. 1 is a schematic overview of the cooling air and pre-cleaner systems of an internal combustion engine in a work machine according to the invention.

DETAILED DESCRIPTION OF PREFERRED EMBODIMENTS OF THE INVENTION

Preferred embodiments will now be described with reference to the drawings. The detailed description is not limiting the scope of the invention, which is defined only by the appended claims. FIG. 1 is a schematic view of the cooling air supply system and engine pre-cleaner system of an internal combustion engine in a work machine according to the invention. The arrows indicate the direction of flow through various components. The expressions 'upstream' and 'downstream' are to be understood with regard to the thus indicated flow directions. According to a preferred embodiment, the work machine is a combine harvester, but the invention is applicable to any work machine that is operable in similar dusty or contaminated environments, such as any kind of forestry or construction vehicle. The engine 1 is visible, supplied with air through air inlet 2. An air pre-cleaner 3 is mounted in the inlet duct, usually upstream of an air filter (not shown). The pre-cleaner may operate according to any known process, for example using centrifugal forces to separate heavier particles in the combustion air from lighter particles. The heavier particles are then removed from the pre-cleaner via a duct 5, while the main air flow including lighter particles continues towards the engine (with lighter particles being removed by the air filter).

The engine is cooled by a liquid coolant that is constantly circulated through a radiator 10, where the coolant is cooled by an air flow produced by a cooling air fan 11, driven by the engine 1. To prevent clogging of the radiator by debris from the air flow, a screen 12 is mounted before the radiator. This may be a rotating screen as known in the art. The debris collected by the screen 12 is evacuated through a duct 13, by the suction created by an aspirator 14 comprising a rotatable fan mounted in a housing. The aspirator fan may be driven by the engine through a suitable pulley system or by an independent power source. All the components described so far are known as such in the art.

According to the invention, a venturi element 16 is mounted downstream of the aspirator 14. Preferably the venturi element is directly coupled to the output port 15 of the aspirator 14. When passing through the venturi element in the direction of flow exiting the aspirator 14, the cross section of the venturi element decreases progressively in a first portion 17, referred to as the inlet portion, until it reaches a minimum in a second portion, referred to as the throat portion 18, after which the cross-section progressively increases again in a third portion 19, referred to as the outlet portion. The duct 5 that is connected at one end to the combustion air pre-cleaner 3 is connected at the other end to the throat portion 18 of the venturi element. The acceleration of the flow through the throat portion 18 causes a suction effect which attracts an air flow containing the particles extracted by the pre-cleaner 3. These particles are evacuated together with the debris collected by the screen 12, through the outlet portion 19 and the outlet section 20 of the venturi element. A number of design parameters and operational parameters, such as the dimensions of the various ducts 5, 13, the type and dimensions of the aspirator 14, the speed of the aspirator fan, the dimensions of the venturi element 16 etc, are configured to produce a flow in the throat portion 18 that generates a sufficient suction effect to attract the particles exiting the pre-cleaner 3.

By placing a venturi element downstream of the aspirator 14, the mixing of debris coming from the screen 12 and particles coming from the pre-cleaner 3 takes place downstream of the aspirator 14, so that the operation of the aspirator is not negatively affected in the manner described in the introduction of the known prior art. The particles coming from the pre-cleaner 3 are not coming in contact with the rotating aspirator fan 14 which results in better performance, and less wear of the rotating parts as well as the housing of the aspirator 14. Furthermore, by placing the venturi in the outlet of the aspirator 14, the duct 13 from the dust screen 12 towards the aspirator 14 is not affected directly. In the design of U.S. Pat. No. 7,878,171, the section of this duct must be adapted—compared to a machine without a venturi—to the increased air flow that is flowing towards the aspirator. The present invention does not require adapting the duct 13, so that existing work machines can be more easily modified to work according to the invention.

The invention claimed is:

1. A work machine, comprising:

an internal combustion engine provided with an air inlet for receiving combustion air, wherein an air pre-cleaner is mounted in the inlet;

a radiator, a cooling air fan and a debris remover, the debris remover being configured to remove debris from a flow of air produced by the cooling air fan through the radiator, the debris remover comprising a screen for collecting the debris and an aspirator for aspiring the debris away from the screen;

a venturi element mounted downstream of the aspirator, the venturi element including an inlet portion, throat portion and an outlet portion, the inlet portion of the venturi element being positioned downstream of the aspirator, wherein a duct is mounted between the engine air pre-cleaner and the throat portion so that particles removed from the combustion air by the pre-cleaner flow towards the throat portion and out through the outlet portion of the venturi element together with the debris aspirated from the debris remover, the venturi element constructed and arranged to be the sole source of suction force to convey the debris through the duct.

2. The work machine according to claim 1, wherein the aspirator comprises an output port and wherein the venturi element is coupled directly to said output port of the aspirator.

3. The work machine according to claim 1, wherein said work machine is a combine harvester.

4. The work machine according to claim 1, wherein the aspirator comprises an output port, the outlet port being positioned upstream of the inlet portion of the venturi element.

* * * * *